United States Patent [19]

Tubbs, Jr.

[11] Patent Number: 4,856,933

[45] Date of Patent: Aug. 15, 1989

[54] HIGH ENERGY RETURN SEAWALL

[76] Inventor: Arthur E. Tubbs, Jr., 921 Saratoga Blvd., Jacksonville, Fla. 32208

[21] Appl. No.: 306,854

[22] Filed: Feb. 7, 1989

[51] Int. Cl.[4] ..... E02B 3/04

[52] U.S. Cl. ..... 405/30; 405/21

[58] Field of Search ..... 405/21–23, 405/28–35; 256/12.5; 244/114 B

[56] References Cited

U.S. PATENT DOCUMENTS

| | | | |
|---|---|---|---|
| 384,173 | 6/1888 | O'Connell | 405/30 |
| 1,175,962 | 3/1916 | Latham | 405/31 |
| 1,811,005 | 6/1931 | Forbes | 405/31 |
| 2,677,240 | 5/1954 | Danel | 405/30 |
| 3,469,403 | 9/1969 | Tanaka et al. | 405/34 |
| 3,845,630 | 11/1974 | Karnas | 405/30 |

FOREIGN PATENT DOCUMENTS

| | | | |
|---|---|---|---|
| 601652 | 2/1960 | Italy | 405/31 |

OTHER PUBLICATIONS

"Structure for Shore Protection" by Jay V. Hall, Civil Engineering, Jul. 1963, pp. 38–41.

*Primary Examiner*—Dennis L. Taylor
*Attorney, Agent, or Firm*—Richard C. Litman

[57] ABSTRACT

A high energy return seawall system which may be assembled on site comprising separate modular units placed along the shoreline for preventing erosion due to severe wave action by dissipating wave energy. Each modular unit includes a plurality of stair steps mounted upon an underlying support structure. A curved baffle is attached to the upper end of the stair steps and has a splash panel extending outwardly from the upper reaches thereof. The seawall system is dimensionally adequate to withstand hurricane force winds, waves and currents and designed to insure the maximum strength for absorbing and dissipating the force of a high energy wave.

16 Claims, 1 Drawing Sheet

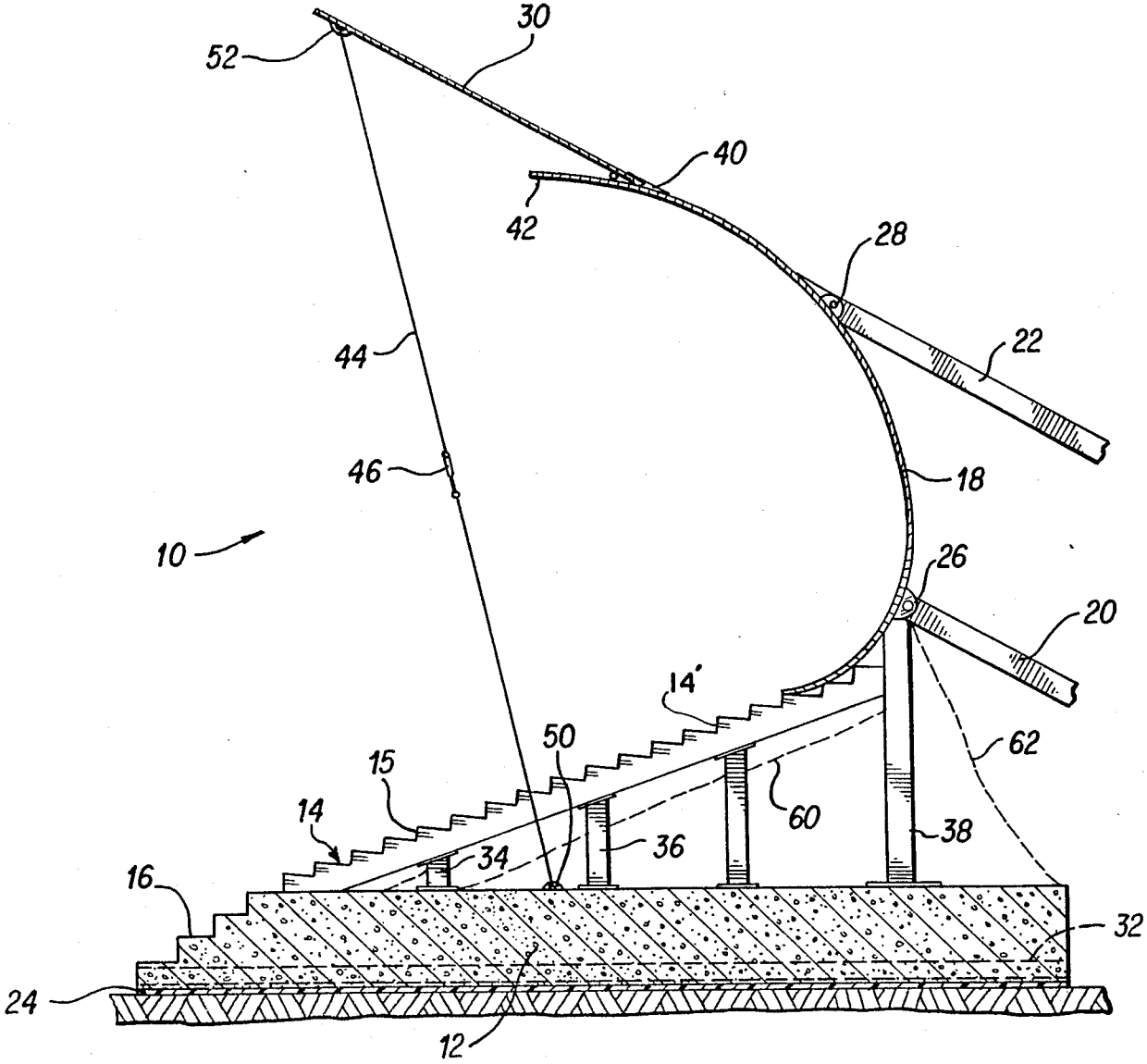
10
12
14
14'
15
16
18
20
22
24
26
28
30
32
34
36
38
40
42
44
46
50
52
60
62

HIGH ENERGY RETURN SEAWALL

This application relates to my prior application, Ser. No. 06/890,291 filed on July 29, 1986, now abandoned.

BACKGROUND OF THE INVENTION

This invention relates to a seawall system for controlling shoreline erosion and preventing damage to construction properties during coastal storms. More particularly, the invention is directed to an adaptable high energy return seawall system having a hydraulically dynamic design which effectively dissipates wave energy under severe storm conditions by causing the kinetic energy within waves to work against itself.

The tremendous power and energy of the sea is quite evident by the extent of destruction caused during coastal storms. When a high energy wave strikes an immovable object such as a vertical concrete structure or bulkhead, the generally clockwise motion of the wave causes most of its energy to go downwardly, producing a scouring action at the base of the structure or bulkhead. This scouring action is the main cause of erosion and results in the massive removal of gravel, sand and other sedimentary materials at the base, causing an overhang to develop which undermines the very foundation on which these structures are built. Any remaining energy from the same high intensity wave is absorbed by direct impact upon the structure or bulkhead itself and repeated wave action of this type causes the structure to weaken and oftentimes to crack under the compounded wave pressure. The intensity of coastal storms is directly related to shoreline erosion and as erosion accelerates, entire beaches and shoreline disappear, buildings and other constructions are washed away to sea, and displaced sand and gravel are carried away by undertows to form undesirable sandbars in channels and shipping lanes.

Various devices and techniques have been proposed in the prior art for protecting shorelines from erosion. One such device is disclosed in U.S. Pat. No. 1,811,055, issued May 23, 1930 to Forbes. This patent describes a seawall comprising a concrete superstructure of the "step and roll way type" and a foundation including a bulkhead and interlocking buttresses of sheet metal piling driven to a depth to prevent undermining by the scouring action of waves and currents. However, the patented device is difficult to construct and maintain, and is simply too expensive to be of any practical significance in protecting the great bulk of beaches and shorelines which are seasonally exposed to severe storm conditions. Moreover, the disclosed device is a permanent structure and may be generally effective along river banks or lake fronts, but not against the ocean during a storm, where storm waves with high wind action could undermine the structure from the rear and cause serious damage to nearby properties and buildings.

More recently, experimental installations of breakwaters made up of concrete modular units have been proposed in the prior art for preserving shorelines under either prevailing or variable ambient conditions. Such modular units, as described in U.S. Pat. Nos. 4,407,608 and 4,498,805, can be separately transported and assembled at the site into a unitary body. One substantial limitation of these prior structures is that they are not very effective during a coastal storm, where storm waves have been reported to approach heights of over 20 feet. Moreover, these breakwater structures are not sufficiently anchored to withstand severe wind and wave conditions and cannot be readily assembled without reliance upon heavy equipment.

SUMMARY OF THE INVENTION

It is accordingly a primary object of the present invention to provide an improved seawall system with a hydraulically dynamic design which effectively dissipates wave energy even under severe storm conditions.

It is another primary object of the present invention to provide a high energy return seawall system for controlling shoreline erosion which causes the wave energy to work against itself and also transfers the energy from an incoming wave to a succeeding wave or waves.

It is among the further objects of the present invention to provide a durable high energy return seawall system which offers the versatility of being either a permanent or temporary structure; may be readily assembled from separately formed sections at the site without total reliance upon heavy equipment; and which is of sufficient dimensions and well-enough anchored on a firm foundation to withstand severe wave and wind conditions.

These and other objects are accomplished in accordance with the present invention by providing a high energy seawall system comprising an underlying support structure, a plurality of stair steps mounted upon the support structure, curved baffle means attached to the upper end of the stair steps and means extending outwardly from the upper reaches of the curved baffle means which provide a splash panel. The set of stair steps is disposed in an upwardly inclined manner which extends away from and substantially broadside to the advance of a sea wave for effectively dissipating incoming wave energy. The curved baffle means extend upwardly, then outwardly in a smoothly curved manner and have a terminal end, extending toward the direction of the sea, disposed substantially above an intermediate section of the plurality of stair steps. Sea waves striking the curved baffle means produce terminal paths of wave energy, wherein at least some of the terminal paths of energy are returned to the area located over and above the stair steps. The splash panel is substantially flat and preferably includes a plurality of perforations which permits seawave water to pass therethrough and fall as droplets behind the seawall structure.

An essential feature of the present invention is a seawall system which is dimensionally adequate to withstand hurricaneforce winds, waves and currents which are the major cause of most of the damage to shorelines, beaches and shoreline properties. Each unit structure measures approximately 44 feet in length and about 30 feet in height, having an underlying foundation measuring approximately 33 feet in width.

Another important feature of the invention is that the degree of curvature of the baffle means is sufficiently great to insure the maximum strength for absorbing and dissipating the force of a high energy wave.

The foregoing and other features, advantages and objects of the invention may be more fully appreciated by reference to the following detailed description and accompanying drawing.

BRIEF DESCRIPTION OF THE DRAWING

The FIGURE is a sectional view of a high energy return seawall modular unit according to a preferred embodiment of the present invention.

DESCRIPTION OF THE ILLUSTRATIVE EMBODIMENT

Referring now to the drawing, there is shown in the FIGURE a high energy return seawall modular unit 10 comprising a concrete base slab structure 12 and a set or series of stair steps 14 having apertures or pass-ways 15 for directing water in jet-like streams therethrough. Steps 14 are mounted on the concrete base slab structure 12 in ascending orientation in relationship to steps 16 of the slab structure 12. Curved baffle member 18 may be substantially semi-circular or semi-parabolic in cross-section and is mounted at the upper end of stair steps 14. Splash panel 30 extends beyond terminal end 42 of curved baffle member 18 and is tangentially affixed thereto by a continuity clip 40, for example.

The slab structure 12 is generally oriented broadside to the oncoming wave and has a series of drainpipe pass-ways 32 extending directly therethrough. Slab structure 12 measures several feet in height and is situated on a polyurethane or heavy double ply plastic mat 24 with crushed concrete disposed therebetween. The mat tends to control and eliminate a degree of erosion from under the base of the slab structure 12. Pass-ways 32 are generally 6 inches in diameter having one-way or unidirectional valves at the front portion of the structure.

The series of stair steps 14 is rigidly supported by a plurality of ascending I-beams 34, 36 and 38 which may be either permanently or temporarily secured terminally to the slab structure 12 and the series of stair steps 14. Each step includes a riser 14' having an aperture 15 therethrough to allow passage of water. Beneath stair steps 14 and behind beam 38 there is positioned webbing members 60 and 62, suitably made of durable Nylon material, which allows water to pass through and permits sand to be trapped. Sand carried by the wave is permitted to pass through apertures 15 and be trapped by the webbing members 60 and 62 and water is allowed to be drained back through the pipes at the base of the pad.

The curved baffle member 18 is disposed in relation to the unit so as to return energy by directional control or dissipational control thereof and so as to produce terminal paths of the wave energy as more fully described hereinafter. Curved baffle member 18 is rearwardly reinforced by support beams 20 and 22, shown pivotally attached thereto at the uppermost ends by pins 26 and 28. Beams 20 and 22 extend diagonally downward into the ground and are rigidly affixed at the opposite ends to concrete footers (not shown).

Splash panel 30 prevented overlap from high waves and is stabilized by cable 44 which is secured to the terminal section of the panel at distal end 52 and at proximal end 50. The tension on cable 44 is tautly adjusted by means of turnbuckle 46.

The high energy return seawall system of the present invention comprises individual modules placed in a line along the shoreline with the concave baffle structure facing directly into the prevailing wind. The modular components of the seawall system may be constructed and adapted to be erected on site in kit form. As the sea moves toward the shoreline in a clockwise manner approaching the rubble and the stairs at the base of the seawall structure, the wave movement is slowed slightly as it moves onto the concave structure. The clockwise motion of the wave is suddenly reversed to a counterclockwise motion at the same time the wind is moving over the wave. As the wind strikes the concave structure of the invention, it also is forced into a counterclockwise motion. As the wave moves swiftly upward and over the structure the counterclockwise motion of the wind spinning over the wave top picks off the top of the over-spray and slings it into the splash panel. The splash panel of the invention is perforated and causes the water to fall in droplets behind the seawall structure. The last part of the wave is pushed over and downward by the same wind action, causing the next incoming wave to slow down and flatten. This flattening effect may be related or correspond to a heavy rain on the surface of the sea.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to within the scope of the appended claims without departing from the spirit of the invention.

I claim:

1. A high energy return seawall system comprising a modular unit having:

an underlying support structure, a plurality of stair steps mounted upon said support structure and disposed in an upwardly inclined manner extending away from and substantially broadside to the advance of sea waves for dissipating energy, curved baffle means attached to an upper end of said stair steps, said baffle means extending upwardly and thence outwardly in a smoothly curved manner and having a terminal end disposed substantially spaced above an intermediate portion of said plurality of stair steps, said terminal end extending toward the direction of the sea, and means extending outwardly toward the sea from the upper reaches of said baffle means to provide a splash panel whereby, sea waves striking said baffle means produce terminal paths of energy with at least some of said terminal paths of wave energy being returned to the area located over and above said stair steps.

2. The seawall system according to claim 1 wherein, said support structure includes a concrete slab.

3. The seawall system according to claim 1 including, securing means extending from said splash panel to said support structure.

4. The seawall system according to claim 1 wherein, said stair steps each include a riser having a vertical extent substantially equal to at least one-half the depth of each said step.

5. The seawall system according to claim 1 wherein, said baffle means is substantially semi-circular in cross-section.

6. The seawall system according to claim 1, wherein, said baffle means is substantially semi-parabolic in cross-section.

7. The seawall system according to claim 1 wherein, the system is contructed in kit form.

8. The seawall system according to claim 1 including, a drainpipe extending through said underlying support structure for providing a return of undertow from behind said support structure to the sea side.

9. The seawall system according to claim 1 wherein, said stair steps each include a riser, and said risers having apertures therethrough allowing for the passage of water.

10. The seawall system according to claim 1 including, support means affixed to the rear of said baffle means and extending downwardly therefrom.

11. The seawall system according to claim 1 including, perforate means mounted beneath said stair steps and baffle means whereby, said perforate means permits the passage of water therethrough while blocking the passage of sand therethrough.

12. The seawall system according to claim 1 including, vertical support means beneath said stair steps maintaining said stair steps in an inclined disposition elevated atop said support structure.

13. The seawall system according to claim 1 including, a continuity member affixing said splash panel to said baffle means whereby said splash panel is tangentially affixed to said baffle means.

14. The seawall system according to claim 1 wherein, said splash panel is substantially flat.

15. The seawall system according to claim 1 wherein, the components of the system are constructed in kit form and adapted to be erected on site.

16. The seawall system according to claim 1 wherein, said splash panel includes a plurality of perforations allowing seawave water to pass therethrough as droplets.

* * * * *